US010113259B2

(12) United States Patent
LV et al.

(10) Patent No.: US 10,113,259 B2
(45) Date of Patent: Oct. 30, 2018

(54) FLANGE STRUCTURE AT BOTTOM OF INNER TUB OF WASHING MACHINE AND A WASHING MACHINE

(71) Applicant: QINGDAO HAIER WASHING MACHINE CO., LTD., Laoshan, Qingdao, Shandong (CN)

(72) Inventors: Peishi LV, Shandong (CN); Lin Yang, Shandong (CN); Baozhen Cheng, Shandong (CN); Lingchen Wang, Shandong (CN); Zunan Liu, Leesburg (CN)

(73) Assignee: QINGDAO HAIER WASHING MACHINE CO., LTD., Qingdao (CN)

( * ) Notice: Subject to any disclaimer, the term of this patent is extended or adjusted under 35 U.S.C. 154(b) by 0 days.

(21) Appl. No.: 15/324,113

(22) PCT Filed: Nov. 18, 2014

(86) PCT No.: PCT/CN2014/091383
§ 371 (c)(1),
(2) Date: Jan. 5, 2017

(87) PCT Pub. No.: WO2016/004718
PCT Pub. Date: Jan. 14, 2016

(65) Prior Publication Data

US 2017/0218547 A1 Aug. 3, 2017

(30) Foreign Application Priority Data

Jul. 7, 2014 (CN) ..... 2014 1 0320139
Jul. 7, 2014 (CN) ..... 2014 1 0320465

(51) Int. Cl.
*D06F 37/26* (2006.01)
*D06F 39/10* (2006.01)

(52) U.S. Cl.
CPC ..... *D06F 37/264* (2013.01); *D06F 37/26* (2013.01); *D06F 37/262* (2013.01); *D06F 39/10* (2013.01)

(58) Field of Classification Search
CPC ..... D06F 37/262; D06F 37/264; D06F 39/10
See application file for complete search history.

(56) References Cited

U.S. PATENT DOCUMENTS 3,481,161 A * 12/1969 Wasemann ..... D06F 13/00 24/605
4,075,876 A * 2/1978 Platt ..... D06F 13/02 210/167.01

(Continued)

FOREIGN PATENT DOCUMENTS

CN 201258415 Y 6/2009
CN 102234902 A 11/2011

(Continued)

OTHER PUBLICATIONS

International Search Report (PCT/ISA/210) dated Mar. 23, 2015, by the Chinese Patent Office as the International Searching Authority for International Application No. PCT/CN2014/091383.

(Continued)

*Primary Examiner* — Joseph L. Perrin
(74) *Attorney, Agent, or Firm* — Buchanan Ingersoll & Rooney PC

(57) ABSTRACT

The present invention discloses a flange structure at a bottom of an inner tub of a washing machine, comprises a shaft joint portion locating at a center of the flange and an annular mounting portion which is fixedly connected with the bottom of the inner tub of the washing machine and is at an outer periphery of the shaft joint portion, and a plurality of connecting portions being provided between the mounting portion and the shaft joint portion. The connecting portions include a main rib extending from the mounting (Continued)

portion to the shaft joint portion, and a plurality of transverse ribs are arranged on both sides of the main rib along an extending direction of a main rib respectively in turn, and a filter portion is formed by the plurality of connecting portions cooperating together, which is a region between the mounting portion and the shaft joint portion.

19 Claims, 3 Drawing Sheets

(56) References Cited

U.S. PATENT DOCUMENTS

| | | | | |
|---|---|---|---|---|
| 4,455,844 | A * | 6/1984 | McMillan | D06F 39/10 210/167.01 |
| 4,848,105 | A * | 7/1989 | O'Connell | D06F 39/10 210/167.01 |
| 5,018,372 | A * | 5/1991 | Altnau, Sr. | D06F 39/10 68/18 F |
| 2011/0146354 | A1* | 6/2011 | Lalonde | D06F 39/085 68/13 R |
| 2013/0160217 | A1* | 6/2013 | Tietz | D06F 39/10 8/137 |

FOREIGN PATENT DOCUMENTS

| | | | |
|---|---|---|---|
| CN | 102733146 | A | 10/2012 |
| CN | 102733148 | A | 10/2012 |
| CN | 202865624 | U | 4/2013 |
| CN | 202865625 | U | 4/2013 |
| JP | S49-77770 | U | 7/1974 |
| JP | S53-159174 | U | 12/1978 |
| JP | S54-142975 | U | 10/1979 |
| JP | 8-323091 | A | 12/1996 |

OTHER PUBLICATIONS

Office Action dated May 8, 2018 by the Japanese Patent Office in corresponding Japanese Patent Application No. 2016-575663. (4 pages).

* cited by examiner

FLANGE STRUCTURE AT BOTTOM OF INNER TUB OF WASHING MACHINE AND A WASHING MACHINE

FIELD OF THE INVENTION

The present disclosure relates to the field of washing machines, and more particularly, to a flange structure at bottom of inner tub of washing machine and a washing machine with the flange structure.

BACKGROUND OF THE INVENTION

A space between an inner tub and an outer tub of the existing washing machine is a closed environment that only water can go though. A bottom of the inner tub of the washing machine is a ring structure, a lower part of the bottom of the inner tub is fitted with a hexagonal flange which comprises a body and six outwardly extending mounting bases, the body is connected with a shaft of the inner tub. The mounting bases are provided with screw mounting pin which are fixedly connected with screws at the lower part of the bottom of the inner tub. Such as a Chinese patent with the application number 200820038868.0 discloses a flange structure of dewatering drum of cylinder washing machine.

Due to the limitation of the structure between inner tub and outer tub of washing machine and the particularity of the using environment, an outer wall of the inner tub and an inner wall of the outer tub are adhering to dirt after using it for 3 to 5 months, thereby breeding bacteria at different levels which most of them are harmful to human bodies.

As the improvement of people's living standards and the quality of life requirements, the hygienic problem of washing machines is very urgent to be solved. The relevant research institutions on the internal environment of the washing machine survey shows that the seriousness of the internal pollution of the washing machine has drawn more and more consumers' attention. In order to fundamentally avoid the washing machine on the secondary pollution of the laundry, and better for the health of users, the washing machine internal environmental cleaning problems is an urgent problem need to overcome.

A patent with application number 201010160548.4 discloses a method for cleaning space between inner and outer tubs of washing machine with flexible particles and washing machine capable of implementing same. The washing machine put flexible particles in the space between the inner and outer tubs of washing machine, through the regular washing process of water flow driving flexible particles to impact and rub walls of tubs to clean the space between the inner and outer tubs.

But the bottom structure of the inner tub of the existing pulsator washing machine, the flange is mounting in the bottom of the inner tub through mounting bases. Between the open area in the center of the inner tub bottom and the position where the flange coaxial mounting retaining a large permeable gap That is a diameter of the flange body is smaller than the inside diameter of the open area in the center of the inner tub bottom, the permeable gap allows the wash water to circulate between the inner tub and the outer tub. But the flexible particles between the inner and outer tubs can enter the inner tub because of the gap, thereby reducing the number of flexible particles number between the inner and outer tubs which affecting the effect of cleaning walls of inner and outer tubs.

A Chinese application number 201210189616.9 discloses a flange structure at a bottom of an inner tub of a washing machine and a washing machine. The washing machine has the function of cleaning the tub walls which including outer tub and inner tub. Between the outer tub and the inner tub there are cleaning particles floating with the water flow to clean the tub walls. The bottom of the inner tub is provided with a flange which prevents the cleaning particles from entering into the inner tub from the bottom. The flange comprises a body and mounting bases which are arranged around the body and fixed to the inner tub. The area which the center of the inner tub bottom corresponds to the flange body is an upper and lower opening. The flange body diameter is equal to or larger than the inner diameter of the opening, or the flange body diameter is smaller than the inner diameter. And the size of the gap between the outer edge of the flange body and the inner edge of the opening is such as to prevent the cleaning particles from entering the inner tub.

The above structure prevents the cleaning particles from entering the inner tub by enlarging the size of the flange body to block the open area of the inner tub bottom, but this structure is not conducive to the flow of water which including the flow of water between the inner and outer tubs during washing and the drainage speed. And at the end of drainage, the lint is easy to accumulate in the bottom of the barrel is not conducive to discharge, thereby breeding bacteria.

In view of the foregoing, the present invention is proposed.

SUMMARY OF THE INVENTION

The technical problem to be solved by the present disclosure is to overcome the shortcomings of the prior art and providing a flange structure capable of preventing the objects disposed between the inner and outer tubs from entering the inner tub through the hollow opening at the bottom of the tub during washing and without affecting the discharge of the water and the lint during the draining.

The other object of the present disclosure is to provide a washing machine with the flange structure.

In order to solve the technical problem mentioned above, the basic idea of adopting the technical scheme of the disclosure is that, a flange structure at a bottom of an inner tub of a washing machine, comprising a shaft joint portion locating at a center of the flange and an annular mounting portion which is fixedly connected with the bottom of the inner tub of the washing machine and is at an outer periphery of the shaft joint portion, and a plurality of connecting portions being provided between the mounting portion and the shaft joint portion. The connecting portions include a main rib extending from the mounting portion to the shaft joint portion, and a plurality of transverse ribs are arranged on both sides of the main rib along an extending direction of a main rib respectively in turn, and a filter portion is formed by the plurality of connecting portions cooperating together, which is a region between the mounting portion and the shaft joint portion.

Further, the connecting portions descends from the main rib towards both sides in an extending direction of the transverse ribs, a V-shaped recess is formed between two adjacent connecting portions, and a V-shaped recess bottom end is a breach of the flange formed by the distance between the transverse ribs of the two main ribs for water flowing.

Further, a backlash is provided between two adjacent transverse ribs on the same side of any one of the main ribs.

Further, an upper surface of the main rib is an arc-shaped surface, which is descended in an arc-shaped transition from a center to both sides, and is smoothly connected with the transverse ribs on both sides.

Further, one end of the transverse rib is connected with the main rib smoothly and the other end is a curved end. An upper surface of the transverse rib is a curved surface which smoothly descends from a high center to both sides. And the transverse rib inclines down from one end connected to the main rib to the other end in the extending direction.

Further, the main rib is arranged in the radial direction of the flange, and each of the transverse ribs is curved and extends in a lateral direction of the main rib, and a curvature is set in correspondence with the circumferential position of the flange.

Further, the transverse ribs on both sides of each main rib arranged in intervals and staggered on different circumferences, or, the transverse ribs on both sides of the same main rib are corresponding one by one, each two in a group is on a same circumference.

Further, the transverse ribs between two adjacent main ribs are corresponding one by one, each two in a group is on a same circumference, or, arranged in intervals and staggered, is on different circumferences.

Further, the transverse ribs of the main ribs in each group are sequentially increased in length in the extending direction of the main rib from a connecting end of the shaft joint portion toward a connecting end of the mounting portion, and an inclination angle of the upper surface of the transverse ribs becomes smaller.

Another flange structure at a bottom of an inner tub of a washing machine of the present disclosure, comprising a shaft joint portion locating at a center of the flange and an annular mounting portion which is fixedly connected with the bottom of the inner tub of the washing machine and is at an outer periphery of the shaft joint portion, and a plurality of connecting portions being provided between the mounting portion and the shaft joint portion. The connecting portion comprises: a main rib which extends from the mounting portion to the shaft joint portion, a plurality of transverse ribs which are arranged on both sides of the main rib in an extending direction of the main rib respectively, a reinforcing rib provided between two adjacent main ribs, one end of which is connected to the mounting portion and the other end of which freely extends toward the shaft joint portion, and a plurality of strengthening ribs are arranged in order in an extending direction of the reinforcing rib on both sides of the reinforcing rib, a space between the transverse ribs of the adjacent main ribs and a space between the transverse ribs the main rib and strengthening ribs of the reinforcing rib adjacent to each other together form a filter portion between the mounting portion and the shaft joint portion.

Further, the main ribs are gradually lowered toward both sides in an extending direction of the transverse ribs, a V-shaped recess is formed between two columns of transverse ribs of the adjacent main ribs. A V-shaped recess bottom end is a breach of the flange formed by the distance between the transverse ribs for water flowing, and/or the reinforcing rib is gradually lowered toward both sides in an extending direction of the strengthening ribs, a gap formed by a distance between a column of the transverse ribs and a column of the strengthening ribs adjacent to each other.

Further, a backlash is provided between two adjacent transverse ribs on the same side of the main ribs, and/or, a backlash is provided between two adjacent transverse ribs on the same side of the reinforcing rib.

Further, an upper surface of the main rib/the reinforcing rib is an arc-shaped surface, which is descended in an arc-shaped transition from a center to both sides, and is smoothly connected with the transverse ribs/strengthening ribs on both sides.

Further, one end of the transverse ribs/the strengthening ribs is connected with the main rib/the reinforcing rib smoothly and the other end is a curved end. An upper surface of the transverse ribs/the strengthening ribs is a curved surface which smoothly descends from a high center to both sides. And the transverse ribs/the strengthening ribs inclines down from one end connected to the main rib/reinforcing rib in the extending direction to the other end. An upper surface of the reinforcing rib and the strengthening ribs is an arc-shaped surface which has a high center and descends from the center to both sides as the same as an upper surface of the main rib and transverse ribs, this structure is conducive to slip lint off, avoid winding and jamming.

Further, the main rib/reinforcing rib are arranged in the radial direction of the flange, and each of the transverse ribs/strengthening ribs is curved is curved and extends in a lateral direction of the main rib the main rib/reinforcing rib, and a curvature is set in correspondence with the circumferential position of the flange.

Further, the transverse ribs on both sides of the main rib and the strengthening ribs of the reinforcing rib are arranged in interval and staggered on different circumferences, or, the transverse ribs on both sides of the main rib and the strengthening ribs on both sides of the reinforcing rib are corresponding one by one, each two in a group is on a same circumference.

Further, the transverse ribs between two adjacent main ribs are corresponding one by one, each two in a group is on a same circumference, or, arranged in interval and staggered on different circumferences.

Further, the transverse ribs of the main rib correspond to the strengthening ribs of the reinforcing rib adjacent to the main ribs one by one, two of them in a group is on a same circumference, or, arranged in intervals and staggered on different circumferences.

Further, a length of the reinforcing rib is smaller than a length of the main rib, preferably less than half the length of the main rib; a length of the strengthening ribs changes corresponding to the change of the length of the transverse ribs of the adjacent main rib, and the strengthening ribs and adjacent transverse ribs cooperate to form a filtration structure.

A general variation is that the length of the transverse ribs of the main rib is gradually increases from one end the shaft joint portion to the other end until a position with the same circumferential as a free end of the reinforcing rib. The length of the transverse ribs and the length of the strengthening ribs of the reinforcing rib cooperate with each other to prevent objects between the inner and outer tubs from entering the inner tub.

The main ribs, the reinforcing rib, the transverse ribs and the strengthening ribs structures in the two flange structures of the present disclosure are conducive to let lint go through during drainage, prevents lint wrapping around components and reduces the possibility of jamming.

Further, the number of the main rib, or main rib and reinforcing rib in the above described two kinds of flange structures is 6 to 18 respectively, but is not limited to this range, the number is related to the size and demand strength of the flange. The larger the flange is and the higher the strength is required, the greater the number of the main rib is.

Further, the mounting portion is provided with a screw mounting hole which is engaged with the inner tub, preferably also a positioning post is provided.

A washing machine with the flange structure mentioned above of the present disclosure, having a function of cleaning tub walls, comprises an outer tub and an inner tub being provided inside the outer tub, the flange being mounted at a bottom of the inner tub, a filter portion being formed by a plurality of connecting portions between the mounting portion and the shaft joint portion, the filter portion can prevent foreign matter between the inner and outer tubs from entering the inner tub during a washing process.

After the foregoing technical solution is adopted, the present disclosure has the following beneficial effects compared with the prior art.

Due to the inner tub bottom is hollow, a filter means is formed by components of the connecting portion of the flange cooperating with each other in the hollow position. The function of the filter means is to facilitate the coins, buttons and other debris that accidentally enter the inner tub to be discharged during drainage, and it can prevent other objects that need to be set between the inner and outer tubs such as cleaning particles from entering into the inner tub along with water flow. Although the flange of the present disclosure can filter the foreign matter from entering the inner tub, but doesn't affect the smooth discharge of the lint during the drainage, that will not cause blockage.

The present disclosure has novel and beautiful design, adopts one-piece molding structure. And the processing is simple and easy to install.

DETAILED DESCRIPTION OF THE INVENTION

Specific embodiments of the present disclosure are further described below in detail with reference to the accompanying drawings.

Figure 1:
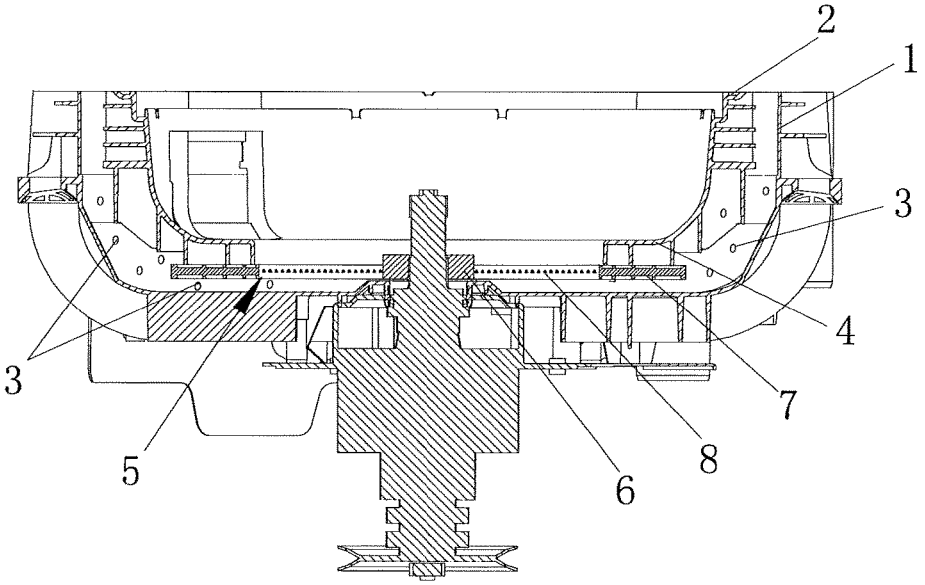
FIG. 1 is a cross-sectional structure diagram of a bottom of an inner tub and a flange structure of a washing machine of the present disclosure.

As shown in FIG. 1, a pulsator washing machine comprises an outer tub 1 and an inner tub 2, an inner tub bottom 4 is a hollow ring structure, a lower part of the inner tub bottom 4 is mounted a flange 5 mentioned in the present disclosure for preventing foreign matter between the inner and outer tubs from entering into the inner tub with water flow during a washing process. And it doesn't block lint and the lint is easily going through the flange into the space between the inner and outer tubs during draining and discharged from a water outlet of the outer tub to outside. There is a rather great improvement between the flange of the present disclosure and an existing flange on which outwardly extended mounting bases are no longer mounted. For the flange of the present disclosure, the overall shape is a disc, the disc is provided with an annular hollow region concentrically and a filter structure is integrally provided in the hollow region.

Figure 2:
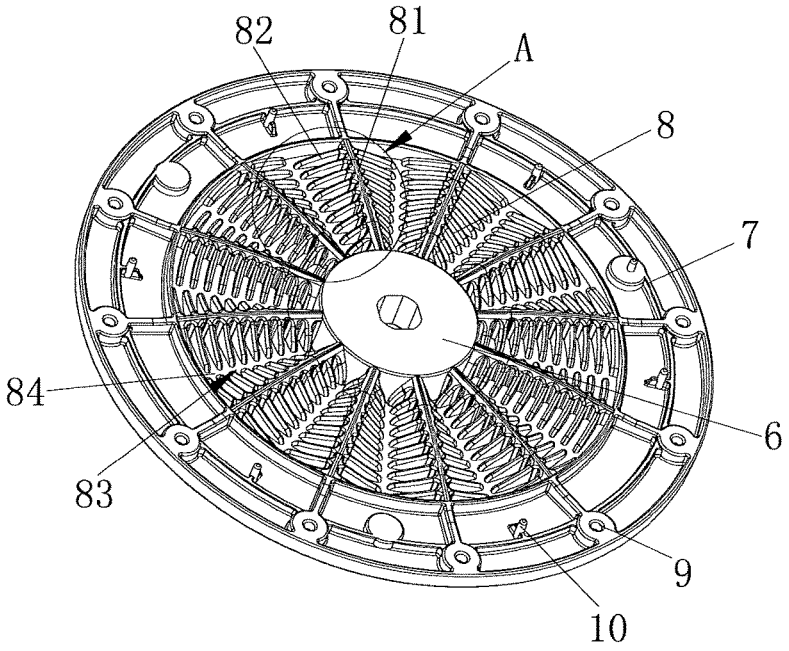
FIG. 2 is a schematic diagram of a flange structure of the present disclosure.
Figure 4:
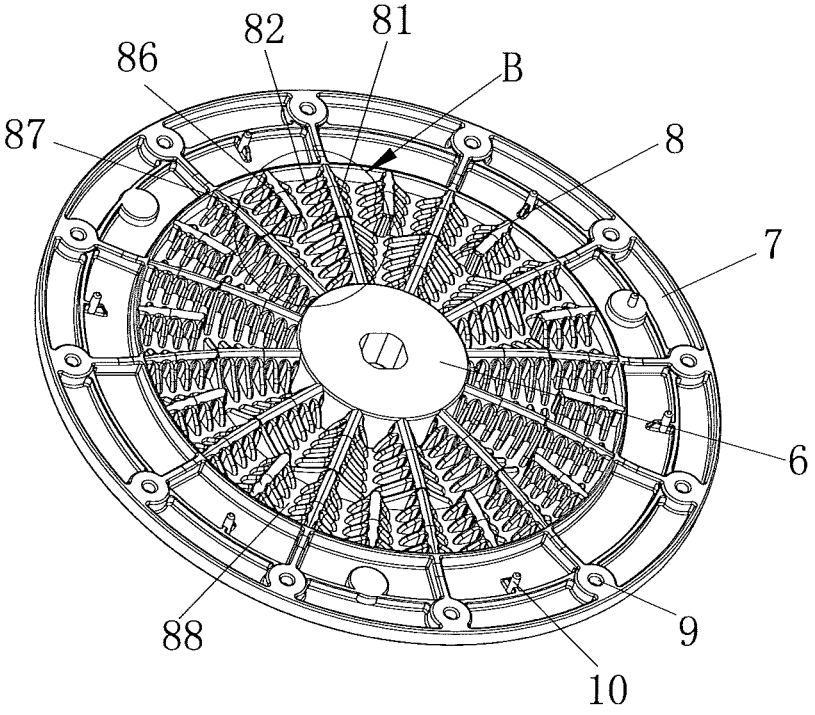
FIG. 4 is a schematic diagram of another flange structure of the present disclosure.

As shown in FIG. 2 and FIG. 4, a flange 5 of the present disclosure, comprises a shaft joint portion 6 locates at a center of the flange and an annular mounting portion 7 which is fixedly connected with the bottom 4 of the inner tub of the washing machine and is at an outer periphery of the shaft joint portion 6, a plurality of connecting portions 8 are provided between the mounting portion 7 and the shaft joint portion 6. The connecting portion 8 includes a main rib 81 extending from the mounting portion 7 to the shaft joint portion 6, and a plurality of transverse ribs 82 are arranged on both sides of the main rib 81 in an extending direction of a main rib 81 respectively in turn, the plurality of connecting portions 8 cooperate to form a filter portion which is a region between the mounting portion 7 and the shaft joint portion 6. Crew mounting holes 9 and positioning posts 10 which cooperate with the bottom of the inner tub 4 are provided on the mounting portion 7.

Further, the connecting portion 8 descends from the main rib 81 towards both sides in an extending direction of the transverse ribs 82, a V-shaped recess 83 is formed between two adjacent connecting portions 8, and a V-shaped recess 83 bottom end is a breach 84 of the flange formed by the distance between the transverse ribs 82 of the two adjacent main ribs for water flowing. Lint, fasteners and other sundries in the inner tub slide along the transverse ribs 82 through the breach 84 into the outer tub.

Figure 3:
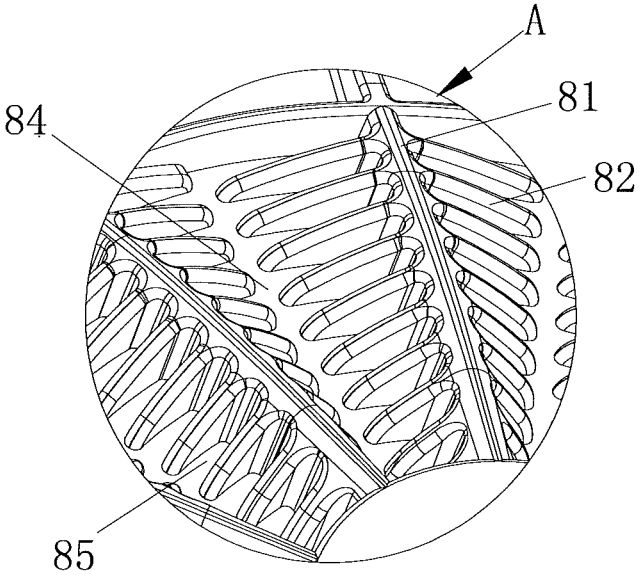
FIG. 3 is an enlargement diagram of A part of the FIG. 2.
Figure 6:
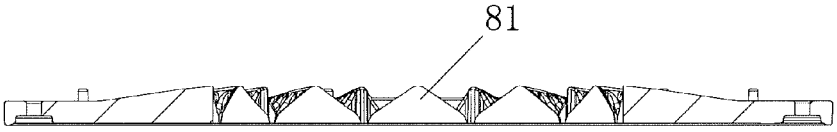
FIG. 6 is a cross-sectional diagram of a flange of the present disclosure.

Further, a backlash 85 is provided between two adjacent transverse ribs 82 on the same side of any of the main ribs 81, and the backlash 85 structure is conducive to let water and lint flow through. As shown in FIG. 6, an upper surface of the main rib 81 is an arc-shaped surface, which is reduced by an arc-shaped transition from a center to both sides, and is smoothly connected with the transverse ribs 82 on both side. One end of the transverse rib 82 is connected with the main rib 81 smoothly and the other end is a curved end (As shown in FIG. 3). An upper surface of the transverse rib 82 is a curved surface which smoothly descends from a high center to both sides. And the transverse rib inclines down from one end connected to the main rib 81 to the other in the extending direction.

Preferably, the main ribs 81 are arranged in the radial direction of the flange, and each of the transverse ribs 82 is curved and extends in a lateral direction of the main rib, and is set in correspondence with a curvature of the circumferential position of the flange. The transverse ribs 82 are located on concentric circumferences of different radii, and the corresponding curvatures are different.

Embodiment 1

As shown in FIG. 2 and FIG. 3, the transverse ribs 82 on both sides of the same main rib 81 of the present embodiment are corresponding one by one, and each two transverse ribs in a group is on a same circle. Or, the transverse ribs 82 on both sides of each main rib 81 are arranged in intervals and staggered on different circumferences.

Embodiment 2

Figure 5:
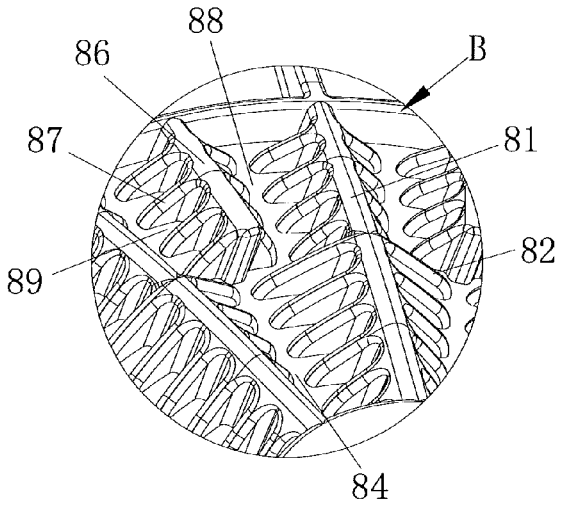
FIG. 5 is an enlargement diagram of B part of the FIG. 4.

As shown in FIG. 2 and FIG. 3, the transverse ribs 82 between two adjacent main ribs 81 of the present embodiment are arranged in intervals and staggered on different circumferences. Or, as shown in FIG. 4 and FIG. 5, two adjacent columns of transverse ribs 82 of two adjacent main ribs are corresponding one by one, each two in a group is on a same circumference.

Embodiment 3

As shown in FIG. 2 and FIG. 3, the connecting portion of the present embodiment has a fishbone structure, that is, the main rib is a vertebra, and the transverse ribs on both sides are transverse barbs. The transverse ribs 82 of the main ribs 81 in each group are sequentially increased in length in the extending direction of the main rib 81 from a connecting end of the shaft joint portion 6 toward a connecting end of the mounting portion 7, and an inclination angle of the upper surface of the transverse ribs 82 becomes smaller.

Embodiment 4

As shown in FIG. 4 and FIG. 5, a cantilever structure is added in the present embodiment based on the embodiment 3. That is a reinforcing rib 86 is provided between two adjacent main ribs 81. One end of the reinforcing rib is connected with a mounting portion 7 and the other end is a free end extends toward a shaft joint portion 6. A plurality of strengthening ribs 87 are sequentially arranged on both sides of the reinforcing rib 86 in the extending direction of the reinforcing rib 86, and strengthening ribs on each side forms a row. Between each row of strengthening ribs 87 and a column of transverse ribs 81 of the main ribs adjacent to the row of strengthening ribs is a gap 88 formed by a distance within, the structure and effect of the gap 88 are the same as the breach 84 between two adjacent main ribs.

The reinforcing rib 86 between the two adjacent main ribs 81 is not completely connected to the mounting portion 7 and the shaft joint portion 6, therefore, a length of the reinforcing rib 86 is smaller than a length of the main rib 81, preferably less than half the length of the main rib 81. Further, a length of the strengthening ribs 87 changes corresponding to the change of a length of the transverse rib 82 of the adjacent main rib 81. The strengthening ribs 87 and adjacent transverse ribs 82 cooperate to form a filtration structure. It blocks the passage of foreign matter between the inner and outer tubs, but allows lint in the inner tub to go through during drainage.

A general variation is that the length of the transverse rib 82 of the main rib 82 gradually increases from one end on the shaft joint portion to the other end until the position with the same circumferential position with a free end of the reinforcing rib 87, the length of the transverse ribs 82 and the length of the strengthening ribs 87 of the reinforcing ribs 86 cooperate with each other to form a filter portion.

Further, one end of the reinforcing rib 86 connected to the mounting portion 7 is smoothly transited and the other end is a smooth end portion. Upper surfaces of the reinforcing rib 86, strengthening ribs 87 are arc-shaped surfaces, as the same as upper surfaces of the main ribs 81 and transverse ribs 82 respectively, of which a center is high and descends toward both sides. It is conducive to lint to slip off and avoid winding.

Embodiment 5

As shown in FIG. 4 and FIG. 5, a backlash 89 is provided between the strengthening ribs 87 on the side of the reinforcing ribs, which are the same as the structure of the transverse ribs 82 of the main ribs 81. The function is the same as the backlash 85 between the transverse ribs. The strengthening ribs 87 on both sides are arranged in intervals and staggered on different circumferences, or, arranged correspondingly one by one and each two in a group is on a same circumference.

Embodiment 6

As shown in FIG. 4 and FIG. 5, a column of strengthening ribs 87 on the same side of the reinforcing rib 86 corresponds one by one to a column of transverse ribs 82 of the adjacent main rib 81. Each pair, that is one strengthening rib and one transverse rib, is on a same circumference; or, arranged in intervals and staggered on different circumferences.

Embodiment 7

The washing machine of the present disclosure has a function of cleaning the walls of tubs, that is, cleaning particles 3 floating and flowing with water that impact and rub tub walls are provided between an outer tub 1 and an inner tub 2 to clean an inner wall of the outer tub and an outer wall of the inner tub (As shown in FIG. 1). The flange structure mentioned above can prevent cleaning particles 3 from entering in the inner tub. The washing machine according to the present disclosure is not limited to the above-described washing machine, and the washing machine having the above-described flange structure is within the scope of the present disclosure.

The main ribs, reinforcing ribs, transverse ribs and strengthening ribs of the present disclosure have the advantages of facilitating the passage of lint during drainage and preventing the lint from winding around the parts, thereby reducing the possibility of blockage. At the same time, the structure can make coins, buttons and other debris go through the backlash, breach and gap between the transverse ribs and strengthening ribs, reducing the possibility of jamming.

A number of the main ribs 81 and the reinforcing ribs 86 mentioned above is 12 respectively, but is not limited to this range, the number is related to the size and demand strength of the flange. The larger the flange, the higher the strength is required the greater the number of the main ribs.

The above description is only preferred embodiments of the disclosure. It should be noted that without departing from the design concept of the present disclosure, various variations and improvements made to the technical solutions of the present disclosure by persons skilled in the art all belong to the protection scope of the present disclosure.

The invention claimed is:

1. A flange structure for use at a bottom of an inner tub of a washing machine, comprising a shaft joint portion located at a center of the flange, an annular mounting portion configured to be fixedly connected with the bottom of the inner tub of the washing machine and located at an outer periphery of the shaft joint portion, a plurality of connecting portions provided between the mounting portion and the shaft joint portion, each connecting portion including a main rib extending from the mounting portion to the shaft joint portion, and a plurality of transverse ribs arranged on both sides of the main rib in an extending direction of the main rib respectively in turn, wherein the connecting portions descend from the main rib towards both sides in an extending direction of the transverse ribs, a V-shaped recess is formed between two adjacent connecting portions, and a V-shaped recess bottom end is a breach of the flange formed by a distance between the transverse ribs of the two main ribs for water flow, and wherein a filter portion is formed in a region between the mounting portion and the shaft joint portion by the plurality of connecting portions.

2. The flange structure according to claim 1, wherein a backlash is provided between two adjacent transverse ribs on the same side of any one of the main ribs.

3. The flange structure according to claim 1 wherein an upper surface of the main rib is an arc-shaped surface which descends in an arc-shaped transition from a center to both sides, and is smoothly connected with the transverse ribs on both sides.

4. The flange structure according to claim 3, wherein one end of the transverse ribs is connected with the main rib smoothly and the other end is a curved end, an upper surface of the transverse ribs is a curved surface which smoothly descends from a high center to both sides, and the transverse ribs incline down from one end connected to the main rib in the extending direction to the other end.

5. The flange structure according to claim 1, wherein the main rib is arranged in the radial direction of the flange, and each of the transverse ribs is curved and extends in a lateral direction of the main rib, and a curvature is set in correspondence with the circumferential position of the flange.

6. The flange structure according to claim 5, wherein the transverse ribs on both sides of each main rib are arranged in intervals and staggered on different circumferences, or, the transverse ribs on both sides of the same main rib are corresponding one by one, each two in a group is on a same circumference.

7. The flange structure according to claim 5, wherein the transverse ribs between two adjacent main ribs are corresponding one by one, each two in a group is on a same circumference, or, arranged in intervals and staggered on different circumferences.

8. The flange structure according to claim 1, wherein the transverse ribs of the main ribs in each group are sequentially increased in length in the extending direction of the main rib from a connecting end of the shaft joint portion toward a connecting end of the mounting portion, and an inclination angle of the upper surface of the transverse ribs becomes smaller.

9. A washing machine, comprising an inner tub and an outer tub mounted inside the outer tub, wherein the flange structure according to claim 1 is mounted at a bottom of the inner tub, and the filter portion is formed by the plurality of connecting portions between the mounting portion and the shaft joint portion.

10. The flange structure according to claim 1, wherein the connecting portion further comprises:

a reinforcing rib provided between two adjacent main ribs, one end of which is connected to the mounting portion and the other end of which freely extends toward the shaft joint portion, a plurality of strengthening ribs arranged in order in an extending direction of the reinforcing rib on both sides of the reinforcing rib, a space between the transverse ribs of the adjacent main ribs and a space between the transverse ribs of the main rib and the strengthening ribs of the reinforcing rib adjacent to each other together form a filter portion between the mounting portion and the shaft joint portion.

11. The flange structure according to claim 10, wherein the main rib is gradually lowered toward both sides in an extending direction of the transverse ribs, a V-shaped recess is formed between two columns of transverse ribs of the adjacent main ribs, and a V-shaped recess bottom end is a breach of the flange formed by a distance between the transverse ribs of the two main ribs for water flow, and/or the reinforcing rib is gradually lowered toward both sides in an extending direction of the strengthening ribs, a gap is formed by a distance between a column of the transverse ribs and a column of the strengthening ribs adjacent to each other.

12. The flange structure according to claim 10, wherein a backlash is provided between two adjacent transverse ribs on the same side of the main rib, and/or, a backlash is provided between two adjacent transverse ribs on the same side of the reinforcing rib.

13. The flange structure according to claim 10, wherein an upper surface of the main rib/the reinforcing rib is an arc-shaped surface which is descended in an arc-shaped transition from a center to both sides, and is smoothly connected with the transverse ribs/the strengthening ribs on both sides.

14. The flange structure according to claim 13, wherein one end of the transverse ribs/the strengthening ribs is connected with the main rib/the reinforcing rib smoothly and the other end is a curved end, an upper surface of the transverse ribs/the strengthening ribs is a curved surface which is smoothly descended from a high center to both sides, and the transverse ribs/the strengthening ribs incline down from one end connected to the main rib/reinforcing rib in the extending direction to the other end.

15. The flange structure according to claim 10, wherein the main rib/reinforcing rib is arranged in a radial direction of the flange, and each of the transverse ribs/strengthening ribs is curved and extends in a lateral direction of the main rib/reinforcing rib, and a curvature is set in correspondence with the circumferential position of the flange.

16. The flange structure according to claim 15, wherein the transverse ribs/strengthening ribs on both sides of each main rib/reinforcing rib are arranged in intervals and staggered on different circumferences, or, the transverse ribs/strengthening ribs on both sides of the same main rib/reinforcing rib are corresponding one by one, and each two in a group is on a same circumference.

17. The flange structure according to claim 15, wherein the transverse ribs of the main rib correspond to the strengthening ribs of the reinforcing rib adjacent to each other one by one, two of them in a group is on a same circumference, or, arranged in intervals and staggered on different circumferences.

18. The flange structure according to claim 10, wherein a length of the reinforcing rib is smaller than a length of the main rib, a length of the strengthening ribs changes corresponding to a change of a length of the transverse ribs of the adjacent main rib, the strengthening ribs and adjacent transverse ribs cooperate to form a filtration structure.

19. The flange structure according to claim 18, wherein the length of the reinforcing rib is less than half the length of the main rib.

* * * * *